United States Patent [19]

Knight

[11] 4,309,779

[45] Jan. 12, 1982

[54] PERSONAL URINAL DEVICE USEABLE BY MALES AND FEMALES

[75] Inventor: Leland W. Knight, Tempe, Ariz.

[73] Assignee: Paul W. Reichert, Phoenix, Ariz.

[21] Appl. No.: 190,226

[22] Filed: Sep. 24, 1980

[51] Int. Cl.[3] ..... A47C 19/06

[52] U.S. Cl. ..... 4/144.3; 4/144.1; 4/454; 4/450

[58] Field of Search ..... 4/144.1, 144.2, 144.3, 4/450, 451, 454, 114.1, 144.4, 301

[56] References Cited

U.S. PATENT DOCUMENTS

| | | | |
|---|---|---|---|
| 661,403 | 11/1900 | Hogan | 4/144.3 |
| 2,084,788 | 6/1937 | Anderson | 4/144.3 X |
| 2,490,969 | 12/1949 | Kinyon | 4/144.3 X |
| 2,542,276 | 2/1951 | Felts | 4/144.3 |
| 2,582,398 | 1/1952 | Sieganthal | 4/144.3 X |
| 3,030,636 | 4/1962 | Evans | 4/144.3 |
| 3,170,170 | 2/1965 | Robillard | 4/144.1 |
| 3,432,863 | 3/1969 | Schwartz | 4/144.2 |
| 3,473,172 | 10/1969 | Friedman et al. | 4/144.3 |
| 3,727,244 | 4/1973 | Collins | 4/144.3 |
| 3,963,020 | 6/1976 | Hall | 4/144.3 |
| 4,045,828 | 9/1977 | Burnham | 4/144.3 |
| 4,050,103 | 9/1977 | Nakao et al. | 4/144.3 |
| 4,121,306 | 10/1978 | Bringman et al. | 4/144.3 |
| 4,187,562 | 2/1980 | Mioduski | 4/144.3 |

*Primary Examiner*—Henry K. Artis

*Attorney, Agent, or Firm*—Cahill, Sutton & Thomas

[57] ABSTRACT

A urinal having a semi-rigid housing is useable by either a male or a female to receive urine discharged by a person whether in a seated or in a supine position. A cappable opening to the collector includes a spout configured to receivingly support a penis when used by a male and the combination of the spout and opening is configured to develop a seal extending from the vaginal opening to a point above the urethra to prevent urine seepage when used by a female. Opposed sides of the collector are concave to mate with the curvature of the user's thighs and help maintain the urinal in place during use. A specially configured handle at the upper rear end of the housing aids in manipulating the urinal into and out of position of use and in minimizing the danger of inadvertent tipping.

22 Claims, 5 Drawing Figures

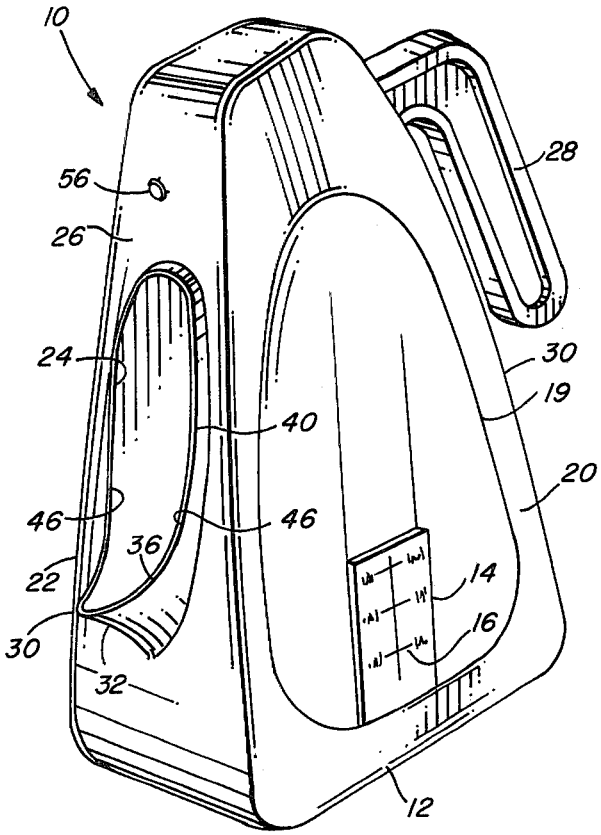
FIG. 1
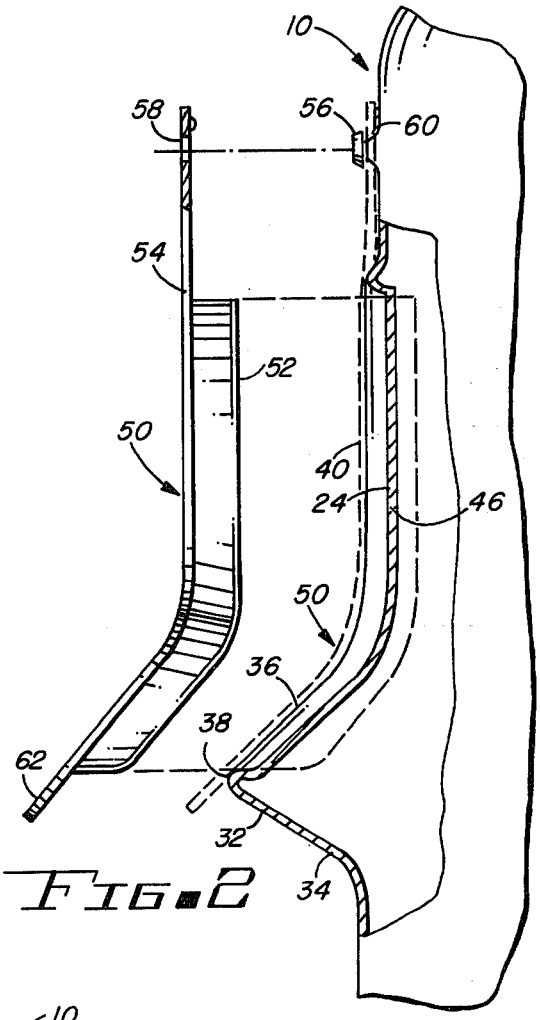
FIG. 2
FIG. 3
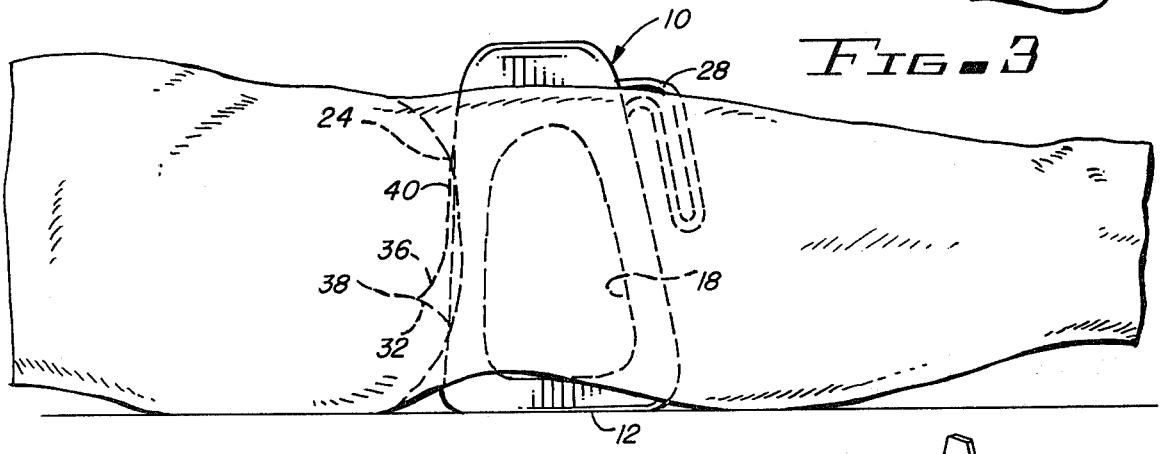
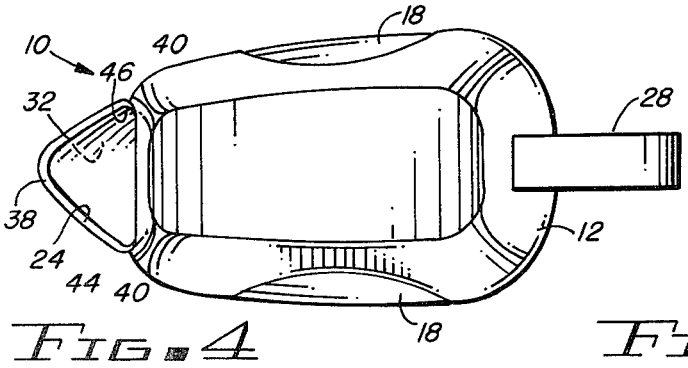
FIG. 4
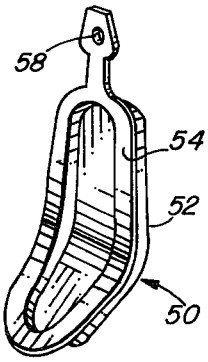
FIG. 5

PERSONAL URINAL DEVICE USEABLE BY MALES AND FEMALES

The present invention relates to urinal devices and, more particularly, to personal urinal devices useable by both males and females.

Various devices have been developed for collecting urine from females to permit voiding of the bladder into a container or for collecting urine specimens. In example, U.S. Pat. No. 1,227,022 is directed to a mattress imbedded bed pan having a hood at one end to catch a horizontal stream of urine. U.S. Pat. No. 2,582,398 discloses a female urinal having an opening defined by a horizontal shelf to catch dripping urine and a vertical shroud to catch a horizontal stream of urine. U.S. Pat. No. 2,542,276 is directed to a female urinal to catch urine by a female in a supine position. The opening thereto includes a lower lip which must be pressed against the flesh posterior of the urethra to preclude seepage. U.S. Pat. No. 3,680,543 is directed to a device for taking a specimen from the mid-stream of micturition after the urethra has been flushed by a flow from the bladder. U.S. Pat. No. 3,815,581 is directed to a device for obtaining a specimen free of extra urethral contamination and includes a channel or trough member inserted within the vaginal passage. U.S. Pat. No. 3,864,759 illustrates a funnel like device for conveying discharged urine to a point external to the body. U.S. Pat. No. 1,951,871 describes a funnel having a flexible inlet opening configurable into an hour glass shape to receive urine discharged from males or females while in a seated position in a vehicle; spillage is primarily avoided only by the user being in a squatting position directly over the inlet. Swedish Pat. No. 194,836 illustrates a funnel for collecting urine from a female which funnel has an elongated vertically oriented opening for enclosing all of the mons pubis, regio perincum and labia majora. U.S. Pat. Nos. 3,964,111 and 4,023,216 describe devices which direct the urine to a container or the like when voiding the bladder is effected from a female in a standing position.

U.S. Pat. No. 3,116,734 describes an intravaginal urinal useable whether the female is standing or in a supine position. Maintenance of the urinal in place is effected by a substantial sized trough retained within and by the vaginal passage. Flexible plastic material overlies the urethra to direct the urine into a collection bag. U.S. Pat. No. 3,963,020 is directed to an intravaginal urinal having a parabolic lip for insertion within the vaginal passage to locate the urinal in place for a female in the supine position. A head section having a vertical opening extends upwardly from the lip to a point below the clitoris to enclose the urethra and catch a horizontal stream of urine.

Over the years, urinals for males have remained a relatively standard configuration due to the ease with which urine discharged from the penis can be effectively completely captured. That is, the urinals have included a circular shroud or sleeve within which the penis is inserted and an attached container collects the discharged urine flowing through the shroud or sleeve. Some variations in size, configuration and angular orientation of the components has occurred but the function of each has been maintained with substantially the same continuing efficiency.

To date, no known urinals are easily, effectively and efficiently useable by both males and females. Accordingly, institutions, such as hospitals, convalescent homes, nursing homes and homes for the aged have an ongoing and continuing need for separate urinals for males and females. The lack of a presently available and commercially satisfactory universal urinal for both males and females requires that these institutions expend very substantial sums for purchasing and storing two types of urinals. Such additional expense adds to the ever increasing costs of personal health and medical care.

The present invention is directed to a universal urinal useable by both males and females. It includes means for channeling urine through an opening into a housing and which opening is specifically configured to support the penis when used by males and to collect urine discharged by a female without any seepage or spillage thereof. Moreover, the urinal itself and the size, height and orientation of the opening is such as to accommodate urine discharge whether the person is seated or lying down in a supine position. A particularly located and configured handle aids in manipulating the urinal during use and to prevent tipping and spilling of collected urine.

It is therefore a primary object of the present invention to provide a urinal useable with equal facility by either males or females.

Another object of the present invention is to provide a personal urinal for women which effects a sealed engagement to prevent urine seepage during discharge.

Yet another object of the present invention is to provide a personal urinal for men which permits comfortable insertion therein of the penis for urine discharge thereinto.

Still another object of the present invention is to provide a urinal useable by either men or women whether seated or in a supine position.

A further object of the present invention is to provide a personal urinal useable by males or females which minimizes the body surface potentially coming into contact with the discharged urine.

A yet further object of the present invention is to provide a universal urinal for males and females which has a cappable and sealable opening.

A still further object of the present invention is to provide an inexpensive universal urinal useable by males or females.

The present invention may be described with greater specificity and clarity with reference to the following drawings, in which:

FIG. 1 is an isometric view of a universal urinal;

FIG. 2 is a partial side cross-sectional view of the urinal opening and cap therefor;

FIG. 3 illustrates the universal urinal in use by a person in a supine position;

FIG. 4 is a top view of the universal urinal; and

FIG. 5 is an isometric view of the cap for the urinal.

Men and women who, because of age, disease or physical infirmity, are no longer freely ambulatory and are relegated to wheel chairs suffer from severe personal problems attendant the act of urinating. Similarly, men and women who are bed ridden in a supine position and who are either not capable of raising their hips by themselves or when such movement is limited because of surgery or pain, severe problems exist attendant the normal multi-daily function of urinating. The choices so far have been that of either using a prior art urinal, the selection of which is dependent upon the sex of the person, and which, more often than not, requires the assistance of another person, using a catheter, or using a diaper-like device for absorbing the discharged urine and commensurately therewith at least partially soiling themselves and their bed clothes.

Although urine can be collected for disposal by any of these three devices, they entail both primary and secondary problems. The primary problems include, in the case of the bed pan type device, selecting a unit commensurate with the sex of the person and for the remaining types of devices, the assistance of another person. The secondary problems are those which result from the seemingly unavoidable contamination of the body by urine irrespective of the prior art devices selected with the resulting danger of tissue inflamation and infection. A third type of problem also exists for both men and women which, though essentially psychological can be very demeaning to the id of the user. That is, the person may feel totally frustrated, ashamed, embarrased and depressed in not being able to perform such a simply natural function as urinating without soiling himself or requiring the aid and assistance of another person. Since all of these problems, directly or indirectly, have an adverse effect upon the well being of the person, whether from the medical or mental standpoint, they should be obviated to the extent possible. Moreover, the urinal to be used should be equally well useable by either males or females. Such a urinal would avoid a panic rush by personnel in a medical institution to select the right sex oriented urinal in an emergency and would eliminate the expense of keeping redundant duplicate quantities of sex oriented urinals.

FIG. 1 illustrates a universal urinal useable with equal facility by either men or women and whether such persons are seated or lying in a supine position. Moreover, the urinal provides an inlet of a configuration effective to preclude seepage or dripping of urine upon the user, the clothing or the bed clothes, whether the user is male or female.

The universal urinal includes a housing 10, which housing tapers upwardly in both the X and Y axis from a base 12. The tapered configuration insures that the center of gravity of the urinal is maintained as low as possible to constrain tipping of the urinal irrespective of the amount of urine discharged thereinto. One or both sides of the urinal may include a transparent or translucent sight window 14, which window includes indicia 16 to provide a measure of the quantity of fluid within the urinal. An indication of the quantity of urine discharged may be particularly important with respect to those users for whom a record of fluid intake and discharge is maintained for various medical reasons.

Housing 10 is predominately rectangular in crosssection to minimize the spacing required intermediate a user's thighs because there may exist problems attendant the hips, muscles or other physical dissabilities which may limit the angle to which a user can spread his or her legs. Moreover, by maintaining the major axis in the horizontal plane of the housing generally aligned with the user's legs, a maximum surface area of the contacting sides of the housing will bear against the user's legs to stabilize the urinal during use. To further insure stabilization, a concave section 18 may be formed in each of sides 20, 22 the curvature of which is at least somewhat duplicative of the corresponding curvature of a user's thighs. Thereby, urinal 10 can and will be comfortably nested and retained in place by the user.

An opening 24 is formed within side 26 of housing 10 to receive urine discharged, whether from a male or a female user. A handle 28 extends from opposed side 30. The portion of handle 28 which is gripped by a user is generally vertically aligned. Several reasons exist for locating handle 28 in this position. First, gripping of the handle requires very little bending of the user's wrist to draw the urinal toward the user. That is, the arm functions necessary to grip handle 28 and reposition the urinal is relatively easily performed by even an infirm person. Second, little wrist movement is required to reposition the urinal horizontally or to raise or lower the urinal; rather, the much stronger and usually less deteriorated muscles of the arm and shoulder are employed for these purposes. Third, lifting of the urinal with a quantity of urine disposed therein to place the urinal on a bedstand or on the floor requires very little wrist movement in that the strength therefor is primarily supplied by the much larger arm and shoulder muscles. Fourth, handle 28 may be confined within an imaginary space extending vertically upwardly from the perimeter of base 12 provided that the slope of side 30 is sufficient to accommodate finger/thumb penetrable space intermediate the handle and the side. The resulting compactness of the urinal is of substantial importance with respect to storage and shipping costs of the urinal. Alternately, as noted in FIG. 4, handle 28 may extend beyond a vertical extension of the confines of base 12 in the event the slope of side 30 is insufficient to accommodate the total width of the handle.

Referring jointly to FIGS. 1 and 2, the configuration and function of opening 24 will be described in detail. The opening includes an inclined forwardly extending protrusion in the manner of a spout 32. Base 34 of the spout is curved to meld smoothly into and with supporting side 26. Upper edge 36 of the spout slopes laterally and upwardly from each side of midpoint 38 of the spout and smoothly melds into the generally vertically oriented remaining edge 40 of opening 24. The curvature of edges 36 and 40 is duplicative of a line extending from the vaginal opening anteriorly and laterally generally coincident with the labia majora to a point anterior of the urethra. To insure a smooth surface of edges 36 and 40, lips 44 and 46 extend inwardly from the edges and interiorly of the opening. The vertical cross-sectional curvature of spout 32 is selected so that it also comfortably supports the underside of a penis.

The significance of opening 24 to collect urine discharge whether by a male or a female, will be described with joint reference to FIGS. 1, 2, 3 and 4. To bring the urinal into place for use, it is placed between the thighs and drawn toward the user, whether the user is seated or lying down as illustrated. For a male, the penis is essentially flaccid when urinating and requires some support to prevent the ejected stream of urine from striking the user's legs and to preclude dripping of urine onto the bed clothes or other supporting surface when the male is seated or in the supine position. By inserting the penis through opening 24, which insertion is relatively easy even by frail males, the penis is comfortably supported upon the interior surface of spout 32 due to the lip at the bottom of the opening and the smooth curvature to base 34. After an initial relatively forceful urine discharge, subsequent dripping will be upon the interior of the spout and will be channeled into the housing due to the slope of the spout. Thus, soiling of the user himself, his clothing or the bed clothes is precluded, whether he is seated or in the supine position.

With respect to a female user, several problems must be overcome to prevent seepage of urine upon the user or the soiling of the user's clothing or bed clothes. Means must be provided to catch and collect an initial ejected stream of urine from the urethra. Additionally, means must be employed to preclude urine from seeping along the labia majora toward the anus. To include all of the vaginal area, as proposed by one of the prior art devices is effective provided a seal can be effected intermediate the vagina and the anus; however, delicate tissues are subjected to the urine which tissues may become painfully inflamed and infected unless wiped clean. Usually, the females who must use urinals are not capable of wiping themselves which requires that they either seek the aid of another person or accept the attendant physical discomforts. The configuration of opening 24 minimizes the flesh exposed to discharged urine and provides a sufficient seal to direct essentially all of the urine into the urinal.

The flesh at and about the opening to the vagina and of the labia majora is of soft conformable tissue. Any firm substance pressed thereagainst will develop a very good seal against fluid flow therebetween. Therefore, spout 36 is configured to locate midpoint 38 adjacent and pressed against the opening of the vagina and extend laterally upwardly therefrom upon the labia majora to either side of the urethra. The flesh in contact with edges 36 and 40 is relatively soft and deformable. The relative firmness of the edges of opening 24 pressed thereagainst will form a very effective seal. The contact with the edges defining the perimeter of opening 24 with the labia majora will continue to some point above the urethra. Thereby, an ejected stream of urine from the urethra will be directed through opening 24 into housing 10. Any dripping or flow of urine downwardly from the urethra will ultimately contact an edge of opening 24. Upon such contact, the urine will be channeled along lip 44/46 interior of the opening and subsequently flow into the urinal itself. Any urine flowing into the somewhat recessed opening of the vagina will not flow into the vagina because of the normally constricted vaginal passageway and instead come in contact with midpoint 38 and be directed into the urinal. Accordingly, any and all urine discharged will flow into the urinal. Any residual urine which may remain intermediate the urethra and the vaginal opening is extremely minute in quantity and cannot be removed except by wiping. However, the very fact that the quantity is so minute essentially precludes any physical discomfort or medical problems resulting therefrom. Moreover, the normal fluids and natural resistance to infection from contact with the residual urine will essentially eliminate problems that would occur on other skin areas of the user.

To prevent loss of the urine from within the urinal during transport thereof, it is preferable that opening 24 be sealed or capped. Such a seal may be effected by a cap 50, as particularly illustrated in FIGS. 2 and 5. The cap includes a continuous flange 52 configured to frictionally engage and mate with the edges and lips of opening 24. Structural rigidity of the flange and a covering for opening 24 is provided by a plate 54 bent in one plane to match the curvature of the opening in the same plane; note in particular FIG. 2.

Retention of cap 50 with the opening may be effected by means of a pedestal mounted button 56 located above opening 24. An aperture 58 is disposed in the upper end of plate 54 which aperture can be brought into forced expansion to penetrably pass therethrough button 56 until the aperture rests upon post 60 supporting the button. To readily attach and detach the cap, a tab 62 extends from the lower end of plate 54.

To remove the cap from the opening, tab 62 is gripped and an outwardly directed force is exerted thereupon to disengage flange 52 with the edges of the opening. Upon disengagement, the cap may be rotated laterally about post 60 to provide access to the opening. To seal the opening, the cap is brought into general alignment with the opening and forced thereinto. Complete removal of the cap may be effected by simply disengaging aperture 58 from button 56. This may be particularly useful for cleaning and sterilizing purposes.

Experimentation with the above described urinal has shown unequivocally that it is very easy to use by any male or female who has sufficient dexterity, strength and locomotion to manipulate a urinal. Moreover, comments by the users indicate that the present invention is easier to use by both males and females than any other urinal with which they have had experience. For males in particular, it was found that the location of handle 28, because of its somewhat raised position with respect to conventional male urinals and its essentially vertical orientation, permitted far more facile and accurate manipulation of the urinal into and out of the position of use. Many comments were received from females about the ease with which the urinal can be pressed against their body to maintain a complete and effective seal with a very low pressure applied at the handle; moreover, many female patients applauded the ability of maintaining the urinal in place by simple compression of their thighs.

It may be pointed out that the urinal may be inexpensively manufactured by presently known mass production techniques attendant the fabrication of man-made plastics.

I claim:

1. A personal urinal adapted for collecting urine from either a male or a female, said urinal comprising in combination:

(a) a housing for collecting the urine;

(b) means for manipulating said urinal into place for use;

(c) an opening disposed in said housing for ingress of urine;

(d) said opening including an edge defining the bottom and sides of said opening, said edge being configured to form a seal with the flesh extending upwardly from the vaginal opening and along either side of the labia majora to a point beyond the urethra on placement of said housing in position for use by a female; and (e) said opening further including a spout defining a segment of said edge and having an interior downwardly sloping surface for supporting the penis on placement of said housing in position for use by a male;

whereby, said urinal is useable effectively and without urine seepage by either males or females.

2. The urinal as set forth in claim 1 wherein said spout extends laterally from said housing and includes a sloping upper extremity defining a segment of said edge.

3. The urinal as set forth in claim 2 wherein said spout includes a midpoint positionable in sealing contact with the vaginal opening.

4. The urinal as set forth in clain 3 wherein the sealing engagement of said edge with the adjacent flesh precludes penetration of said midpoint into the vaginal passageway.

5. The urinal as set forth in claim 4 wherein said opening is oblong and the major axis of the oblong lies in the vertical plane.

6. The urinal as set forth in claim 5 wherein said manipulating means includes a handle disposed on said housing on a side opposite said opening.

7. The urinal as set forth in claim 6 wherein said housing includes a sight window.

8. The urinal as set forth in claim 6 wherein said housing includes a base and said housing tapers upwardly from said base to maintain the center of gravity of said urinal below the midpoint of said housing.

9. The urinal as set forth in claim 8 wherein each of a pair of opposed sides of said housing includes a concave section conforming with the curvature of the user's thighs.

10. The urinal as set forth in claim 1 including a cap for sealing said opening, said cap comprising in combination a continuous flange penetrably engaging said opening and a plate extending across said opening for supporting said flange and covering said opening.

11. The urinal as set forth in claim 10 wherein said cap includes means for retaining said cap fixed to said housing during use and non-use of said urinal.

12. The urinal as set forth in claim 11 wherein said cap includes a tab for aiding in removal and replacement of said cap.

13. The urinal as set forth in claim 1 wherein said edge includes a lip for providing a smooth contact area with the flesh.

14. The urinal as set forth in claim 13 wherein said lip extends inwardly of said opening and toward the interior of said housing.

15. A personal urinal having a housing for collecting urine from either males or females, said urinal comprising in combination:

(a) means for manipulating the housing into and out of the position of use;

(b) an opening disposed in the housing for ingress of the urine;

(c) a spout defining the lower perimeter of said opening and extending laterally of the housing and sloping downwardly toward the housing to channel urine into the housing;

(d) said spout including a surface for supporting at least a part of a penis to direct a discharge of urine into the housing on use of said urinal by a male;

(e) said spout including an upper edge extending laterally and upwardly in each direction from the midpoint of said spout, said spout being dimensional to locate the midpoint at the vaginal opening and conform each of said edges to extend in contacting relationship with the flesh toward and into contact with the opposed parts of the labia majora on use of said urinal by a female;

(f) said opening including further edges extending upwardly from each of said edges to at least a point above the urethra;

(g) means for sealing said edges and at least a part of said further edges with the flesh adjacent thereto to channel all urine discharged by a female into said housing;

whereby, said urinal is useable effectively by either males or females to collect urine.

16. The urinal as set forth in claim 15 wherein said opening is oblong and the major axis of the oblong lies in the vertical plane.

17. The urinal as set forth in claim 15 wherein said manipulating means including a handle disposed on said housing on a side opposite said opening.

18. The urinal as set forth in claim 15 including a cap for sealing said opening, said cap comprising in combination a continuous flange penetrably engaging said opening and a plate extending across said opening for supporting said flange and covering said opening.

19. The urinal as set forth in claim 18 wherein said cap includes means for retaining said cap fixed to said housing during use and non-use of said urinal.

20. The urinal as set forth in claim 19 wherein said cap includes a tab for aiding in removal and replacement of said cap.

21. The urinal as set forth in claim 15 wherein said edge includes a lip for providing a smooth contact area with the flesh.

22. The urinal as set forth in claim 21 wherein said lip extends inwardly of said opening and toward the interior of said housing.

* * * * *